US007287570B2

(12) United States Patent
Strand

(10) Patent No.: US 7,287,570 B2
(45) Date of Patent: Oct. 30, 2007

(54) WINDOW COVERING LIFTING SYSTEM AND METHOD

(75) Inventor: Toralf H. Strand, Madison, WI (US)

(73) Assignee: Springs Window Fashions LP, Fort Mill, SC (US)

( * ) Notice: Subject to any disclaimer, the term of this patent is extended or adjusted under 35 U.S.C. 154(b) by 317 days.

(21) Appl. No.: 10/951,216

(22) Filed: Sep. 27, 2004

(65) Prior Publication Data

US 2005/0109471 A1 May 26, 2005

Related U.S. Application Data

(60) Provisional application No. 60/510,369, filed on Oct. 10, 2003.

(51) Int. Cl.
*E06B 9/30* (2006.01)

(52) U.S. Cl. ..... 160/171; 160/84.05; 160/308

(58) Field of Classification Search ..... 160/171, 160/170, 84.04, 84.01, 321, 298, 299, 305, 160/307, 308, 168.1 R, 173 R, 178.1 R, 160/178.2 R, 176.1 R, 177 R, 405
See application file for complete search history.

(56) References Cited

U.S. PATENT DOCUMENTS 2,420,301 A * 5/1947 Cusumano ..... 160/170
3,141,497 A * 7/1964 Griesser ..... 160/170
3,633,646 A * 1/1972 Zilver ..... 160/168.1 R
4,779,662 A * 10/1988 Wilk ..... 160/321
5,482,100 A 1/1996 Kuhar
5,482,105 A 1/1996 Rude
5,628,356 A 5/1997 Marocco
5,651,775 A 7/1997 Walker et al.
5,906,232 A 5/1999 Bauer et al.
5,927,370 A 7/1999 Judkins
5,960,846 A * 10/1999 Lysyj ..... 160/84.04
6,012,506 A * 1/2000 Wang et al. ..... 160/170
6,056,036 A 5/2000 Todd et al.
6,129,131 A 10/2000 Colson
6,142,211 A 11/2000 Judkins
6,164,428 A * 12/2000 Berman et al. ..... 192/223.4
6,189,595 B1 * 2/2001 Lee ..... 160/168.1 R
6,283,192 B1 * 9/2001 Toti ..... 160/170
6,293,329 B1 9/2001 Toti
6,571,853 B1 6/2003 Ciuca et al.
6,644,372 B2 11/2003 Judkins
6,644,375 B2 11/2003 Palmer
6,648,050 B1 * 11/2003 Toti ..... 160/170
6,662,850 B2 * 12/2003 Chung et al. ..... 160/171
6,675,861 B2 1/2004 Palmer et al.
6,761,203 B1 * 7/2004 Huang ..... 160/170
2003/0221799 A1 12/2003 Cross et al.

FOREIGN PATENT DOCUMENTS

CA 2 403 384 9/2002

* cited by examiner

*Primary Examiner*—David Purol
(74) *Attorney, Agent, or Firm*—Lerner, David, Littenberg, Krumholz & Mentlik, LLP

(57) ABSTRACT

A window covering, a lifting system for a window covering and a release mechanism for a lifting mechanism are disclosed. The window covering includes a head rail, a bottom rail, a window covering, a drive shaft and a lift cord attached to the bottom rail. The release mechanism includes a spring coupled to the drive shaft for preventing or allowing rotation. Methods of assembling and raising and lowering window coverings are also disclosed.

26 Claims, 17 Drawing Sheets

WINDOW COVERING LIFTING SYSTEM AND METHOD

CROSS-REFERENCE TO RELATED APPLICATIONS

This application claims the benefit of the filing date of U.S. Provisional Patent Application Ser. No. 60/510,369 filed Oct. 10, 2003, the disclosure of which is hereby incorporated herein by reference.

FIELD OF THE INVENTION

This invention relates to window coverings and lift systems for window coverings, methods of raising window coverings using such lift systems, and release mechanisms for such lift systems.

BACKGROUND OF THE INVENTION

Window coverings such as Venetian blinds, Roman blinds, pleated shades and cellular shades are typically raised by pulling an outer pull cord. Venetian blinds typically comprise a plurality of horizontal slats suspended beneath a head rail by two or more flexible ladder laces. The ladder laces each include a pair of vertically extending side cords interconnected by a plurality of vertically spaced slat supporting rungs, and the upper ends of the ladders are attached to a ladder drum or tilt drum to tilt the slats in response to turning of the ladder drum. Carriers for the several ladders typically are rotated in unison by a tilt rod. Cellular shades typically comprise a head rail, a bottom rail, and a continuous, collapsible web of material suspended between a head rail and a bottom rail that is raised or lowered with an outer pull cord.

Recent improvements to Venetian blind and cellular shade lifting mechanisms have involved the use of spring motor lifting mechanisms. Spring motor lifting mechanisms provide lifting force for the bottom rail and the window covering, and the lifting mechanism allows the lifting cords to be concealed in the body of the window covering. The cords are stored on spools associated with the lifting mechanism. Spring motors are well-known and generally include a flat ribbon of pre-stressed spring metal coiled to have a natural or relaxed state in which the spring forms a tightly wound coil. Although a variety of window covering lifting mechanisms presently exist, improvements in such lifting mechanisms are always desirable.

SUMMARY OF THE INVENTION

In accordance with one or more embodiments of the present invention, a window covering, a lift system, a release mechanism and a method of raising a window covering are provided.

According to one aspect of the present invention, there is provided a window covering assembly comprising a head rail, a bottom rail, at least one lift cord running through the head rail and the bottom rail, and a window covering extending between the head rail and the bottom rail, wherein the window covering is operatively connected to the lift cord. There is also a lift system for raising and lowering the window covering that biases the window to move in an upward direction. The assembly further comprises a wrap spring operatively engaged with the lift system. The wrap spring is configured to selectively prevent or permit the raising and lowering of the window covering.

In accordance with one embodiment of this aspect of the invention, the window covering further includes a rotatable drive shaft and a spring motor coupled to the drive shaft. The wrap spring has a locked state for preventing rotation of the drive shaft, and an unlocked state for allowing rotation of the drive shaft.

In accordance with another embodiment of this aspect of the invention, the wrap spring is wrapped in a direction to prevent the raising of said window covering.

In accordance with still another embodiment of this aspect of the invention, the drive shaft rotates in a first direction when the wrap spring is in the loosened state.

In accordance with yet another embodiment of this aspect of the invention, the drive shaft is prevented from rotating in a first direction when the wrap spring is in the locked state.

In accordance with another embodiment of this aspect of the invention, the drive shaft rotates in a first direction to raise said window covering.

In accordance with another embodiment of this aspect of the invention, the drive shaft rotates in a first direction to lower the window covering.

In accordance with another embodiment of this aspect of the invention, the wrap spring is coaxially aligned with the drive shaft.

According to another aspect of the present invention, there is provided a window covering assembly comprising a head rail, a bottom rail, a window covering extending between the head rail and the bottom rail, at least one lift cord extending between the head rail and the bottom rail, and a lift system associated with the head rail. The lift system includes a rotatable drive shaft mounted in the head rail, a spring motor coupled to the drive shaft, and a wrap spring associated with the drive shaft. The wrap spring has a tightened configuration for preventing rotation of the drive shaft, and a loosened configuration for allowing rotation of the drive shaft.

In accordance with an embodiment of this aspect of the invention, the lift system further includes a first gear coupled to the spring motor, and the first gear is engaged with a second gear coupled to the drive shaft.

In accordance with another embodiment of this aspect of the invention, a trigger cord is attached to the wrap spring to selectively engage the wrap spring between the tightened and loosened configurations.

In accordance with yet another embodiment of this aspect of the invention, a hollow tilt wand is coupled to the head rail, and the trigger cord is threaded through the tilt wand.

In accordance with still another embodiment of this aspect of the invention, the window covering includes a Venetian blind.

In accordance with another embodiment of this aspect of the invention, the window covering includes a cellular shade.

In accordance with yet another embodiment of this aspect of the invention, the window covering includes a pleated shade.

In another aspect of the present invention, the window covering assembly comprises a head rail, a bottom rail, a window covering extending between the head rail and the bottom rail, at least one lift cord extending between the head rail and the bottom rail, and a lift system associated with the head rail. The lift system includes a rotatable drive shaft mounted in the head rail, a torsion spring associated with the drive shaft, and a wrap spring associated with the drive shaft. The wrap spring has a locking mode for preventing rotation of the drive shaft, and a released mode for allowing rotation of the drive shaft.

In accordance with an embodiment of this aspect of the invention, a trigger cord is coupled to the wrap spring.

In accordance with an embodiment of this aspect of the invention, a drive shaft housing surrounds at least a portion of the drive shaft, and a wrap spring control is coupled to the wrap spring.

In accordance with another embodiment of this aspect of the invention, the wrap spring has a first end and a second end. The first end of the wrap spring is located within the drive shaft housing, and the second end is coupled to the wrap spring control.

In accordance with a further embodiment of this aspect of the invention, the wrap spring control is operable to move the wrap spring between the locking mode to prevent rotation of the drive shaft and the released mode to allow rotation of the drive shaft.

In a further aspect of the present invention, a window covering assembly comprises a head rail, a bottom rail, a window covering extending between the head rail and the bottom rail, at least one lift cord extending between the head rail and the bottom rail, at least one pair of ladder cords for supporting a plurality of slats, and a lift system associated with the head rail. The lift system includes a rotatable shaft assembly and a drive shaft mounted in the head rail, a tube mounted around a portion of the drive shaft, wherein one end of the tube is slidably engaged with the drive shaft. The other end of the tube is engaged with a threaded rod to allow a sideways translation of the tube as the tube rotates. There is also a spring motor associated with the drive shaft, a wrap spring associated with the drive shaft, wherein the wrap spring is wrapped in a manner to prevent rotation of the drive shaft and tube in a pre-determined direction.

In accordance with another embodiment of this aspect of the invention, the spring motor includes an output drum and a coil spring.

In accordance with another embodiment of this aspect of the invention, the lift system further comprises a trigger cord attached to a first end of the wrap spring. The wrap spring is loosened to allow rotation of the drive shaft and tube in the pre-determined direction when the trigger cord is engaged.

In still another aspect of the present invention, a window covering comprises a head rail, a bottom rail, a window covering extending between head rail and bottom rail, a lift cord attached to the bottom rail, a take up member located in the head rail for taking up the lift cord when the window covering is raised, a lifting mechanism further including a shaft associated with a head rail, a spool mounted to the shaft, a spring motor for driving the spool, and a release mechanism. The release mechanism includes a wrap spring prevent rotation of the tube in a direction that will lower the window covering, and a trigger in communication with the wrap spring for releasing the wrap spring so as to allow the spool to rotate and the blind to be lowered.

In accordance with another aspect of the invention, there is a method for the assembly of a window covering assembly comprising providing the components of a window treatment which include a head rail, a bottom rail, a window covering disposed between the head rail and bottom rail, a drive shaft, and a spring motor. Sufficient weight is provided in the bottom rail so that the base rail provides a greater downward force than the upward force provided by the spring motor. The wrap spring is coupled to the drive shaft to prevent rotation of the drive shaft in a downward direction, and a trigger cord is attached to the wrap spring so as to allow rotation of the shaft in a downward direction when a user pulls on the trigger cord.

In accordance with another aspect of the invention, there is provided a method for the assembly of a window covering assembly comprising providing the components of a window treatment that include a head rail, a bottom rail, a window covering disposed between the head rail and base rail, a lift cord, torsion spring, drive shaft, and wrap spring. The components are assembled so that the torsion spring is disposed in the head rail to provide an upward lifting force for raising the window covering. The wrap spring is wrapped in a direction that prevents rotation of the drive shaft in a predetermined direction.

In accordance with another aspect of the invention, there is a method for the raising and lowering of a window covering including a drive shaft operably connected to the window covering comprising biasing the drive shaft to move in a predetermined direction and applying a compressive force to the drive shaft or a member coupled to the drive shaft to prevent rotation of the drive shaft. The compressive force is released from the drive shaft or a member coupled to the drive shaft to permit rotation of the drive shaft and movement of the window covering.

In accordance with an embodiment of this aspect of the invention, the compressive force is applied by a wrap spring.

In accordance with yet another aspect of the present invention, a window covering assembly comprises a head rail, bottom rail, at least one lift cord running through the head rail and the bottom rail and a window covering extending between the head rail and the bottom rail. The window covering is operatively connected to the lift cord. The window covering assembly further comprises a lift system for raising and lowering the window covering, including a means for biasing the bottom rail to move in an upward direction; and a means for providing locking force to prevent the bottom rail from moving in an predetermined direction.

These and other features and characteristics of the present invention will be apparent from the following detailed description of preferred embodiments which should be read in light of the accompanying drawings in which corresponding reference numbers refer to corresponding parts throughout the several views.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF EXEMPLARY EMBODIMENTS

Before describing several exemplary embodiments of the invention, it is to be understood that the invention is not limited to the details of construction or process steps set forth in the following description. The invention is capable of other embodiments and of being practiced or carried out in various ways, and including configurations and sub-configurations of the various features described herein.

In overview, one or more embodiments of the invention relates to a window covering lift system. Certain embodiments relate to window coverings utilizing lift systems that bias the window covering to move in an upward direction. Other embodiments relate to locking and release mechanisms for window lift systems to selectively prevent or allow motion of the window covering in a predetermined direction. Still other embodiments involve methods of assembling or lifting window coverings.

Figure 1:
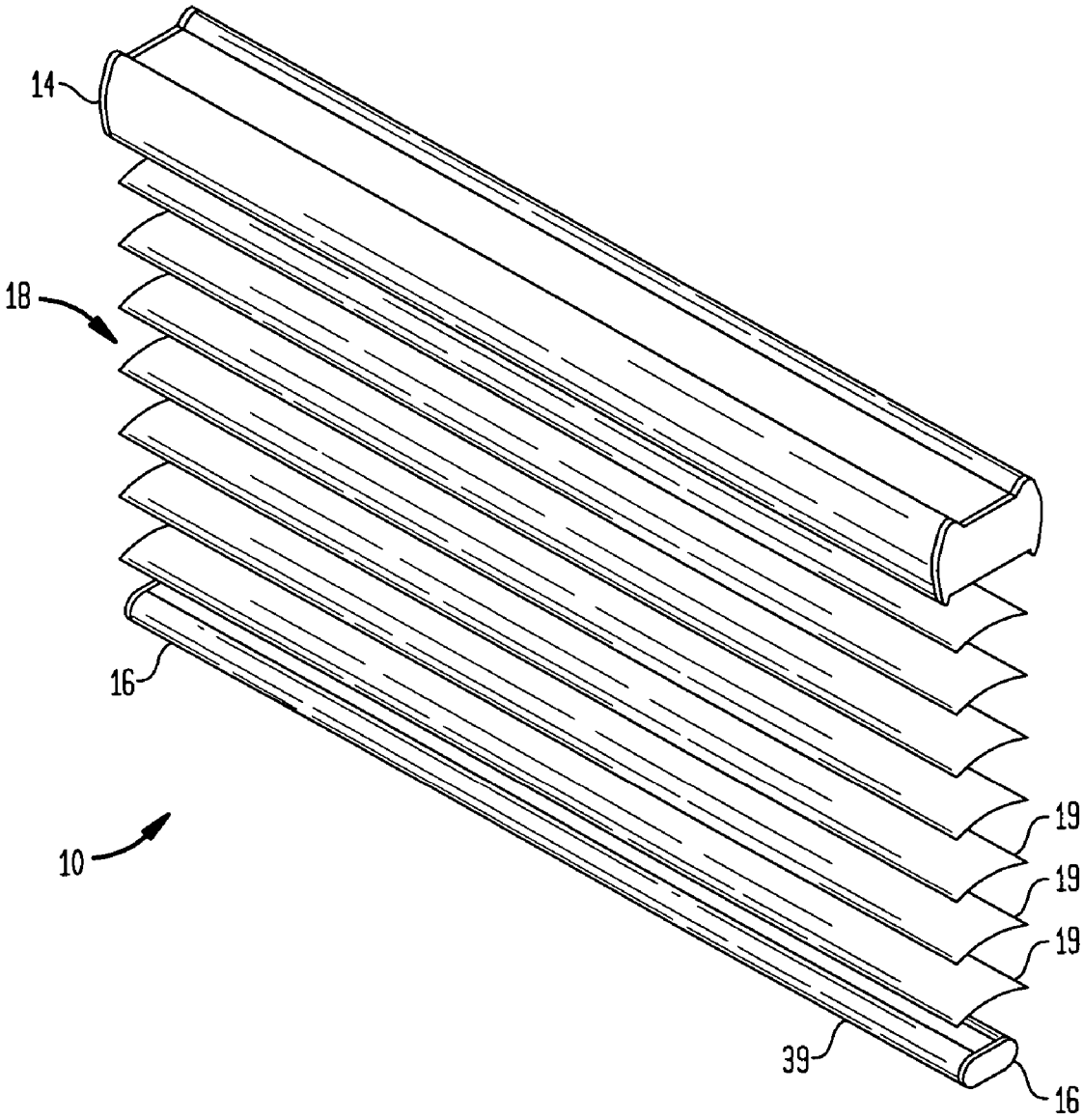
FIG. 1 is a perspective view of a blind assembly according to one embodiment of the present invention.
Figure 2:
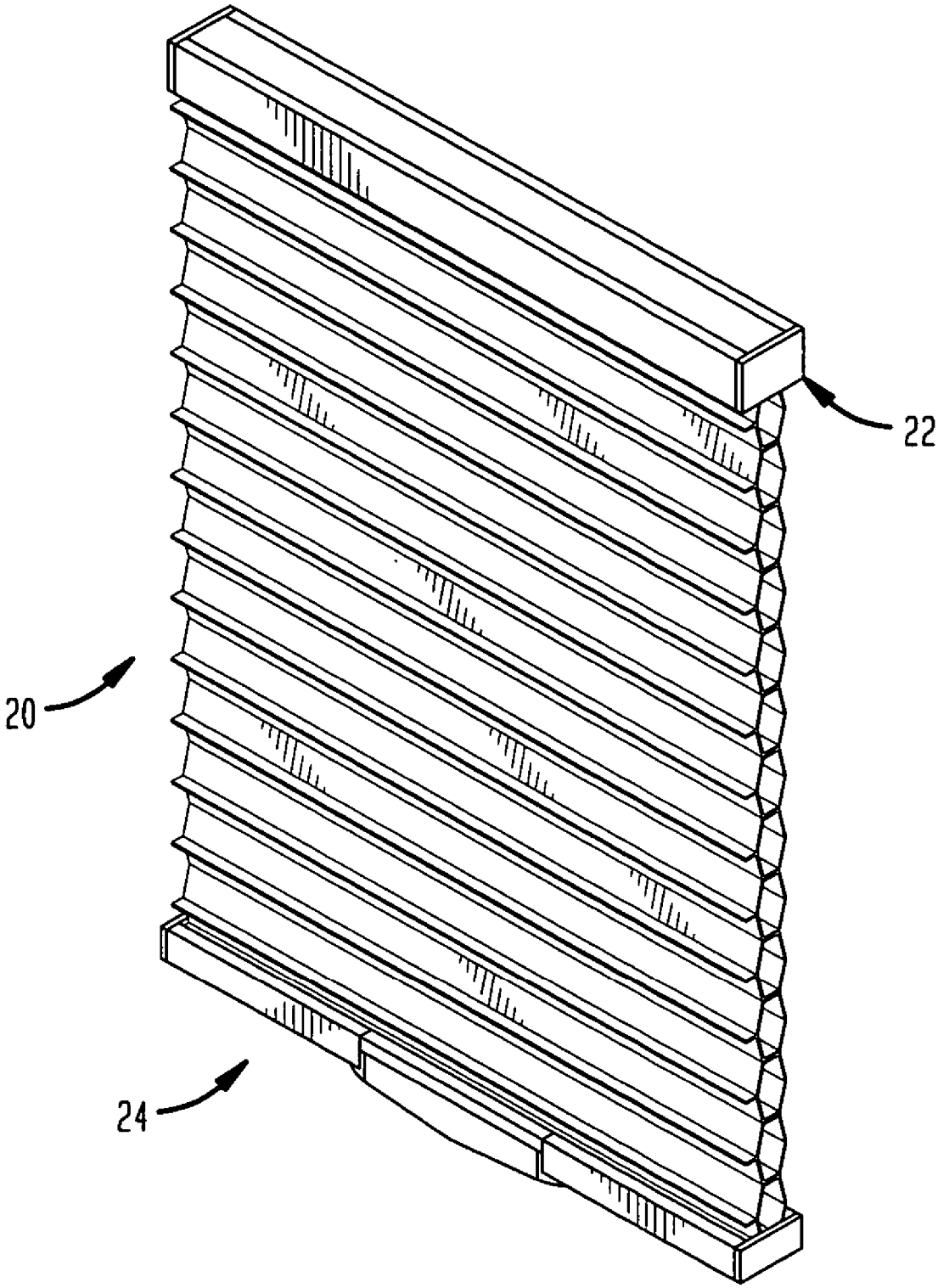
FIG. 2 is a perspective view of a cellular shade assembly including a lifting mechanism according to one embodiment.

Referring to the drawings and specifically to FIGS. 1-2, window covering assemblies utilizing a lift system are shown according to one or more embodiments. FIG. 1 show a Venetian blind assembly 10. Venetian blind assemblies typically include a head rail 14, a bottom rail 16, and a window covering 18 extending between the head rail 14 and the bottom rail 16. The window covering 18 shown in FIG. 1 includes a plurality of individual slats 19 as is known in the art of Venetian blinds. As is also known in the art, at least one cord, and preferably, a pair of cords (not shown) connect the head rail 14, the bottom rail 16, and the window covering 18.

FIG. 2 shows a window covering assembly according to another embodiment of the invention, in the form of a cellular shade assembly 20. The window covering assembly 20, includes a head rail 22, a bottom rail 24, and a window covering 26 extending between the head and bottom rail. As is known in the art, at least one, and preferably a pair of lift cords (not shown) extend between the head rail 22 and the bottom rail 24. It will be understood that the present invention is not limited to the type of blind assemblies shown in FIGS. 1 and 2, and other blind assemblies including, but not limited to Roman shades and pleated shades using lift systems described herein are within the scope of one or more embodiments of the present invention.

Referring now to FIGS. 3-9, a lift system for a Venetian blind type of window covering assembly is shown according to one embodiment of the present invention. The assembly shown in FIGS. 3-10 is a Venetian blind type of window assembly 30 comprising a plurality of slats 32. One or more lift cords 34 and one or more ladder cords 62 extend between the head rail 38 and the bottom rail 39, and rungs (not shown) extend between the ladder cords 36 for supporting and rotating the slats 32. The lift cords extend between a head rail 38 which, in the embodiment shown, is an U-shaped head rail and a bottom rail 39 (see FIG. 8).

Figure 3:
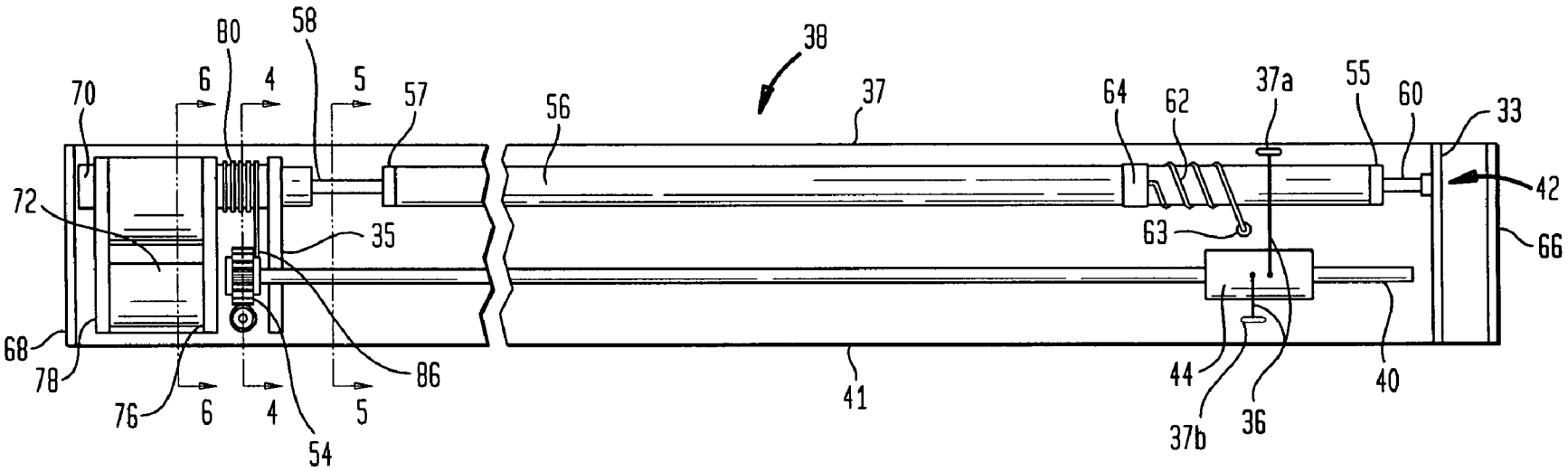
FIG. 3 a top plan view of a head rail including a lift system for use in a blind assembly according to one embodiment.

As best shown in FIG. 3, the head rail 38 includes a front panel 37 and a rear panel 41, and two horizontally extending and generally parallel shaft assemblies that are mounted therein for rotation. The shafts extend between an end support 33 and a tilter support 35 mounted in the head rail 38 and may also be attached to cradles (not shown) to provide additional support. A first shaft is a tilt rod 40 on which is mounted one or more ladder drums 44, to which are affixed the top ends of ladder cords 36. The ladder cords 36 are threaded through at least one ladder cord opening 37*b* in the head rail.

Figure 4:
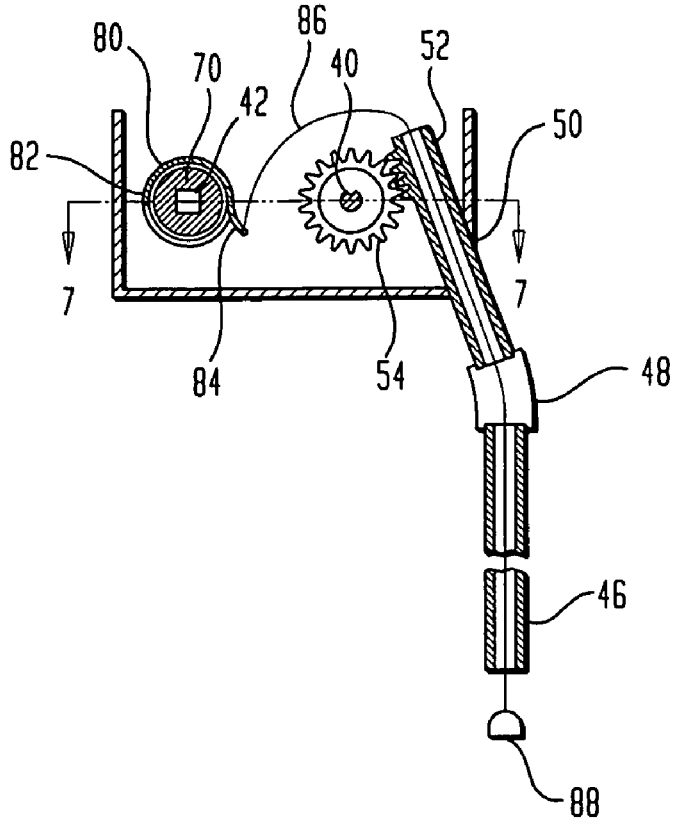
FIG. 4 is a cross-sectional view taken along line 4-4 of FIG. 3.

As best shown in FIG. 4, the tilt rod 40 is operated with a tilt wand mechanism including a tilt wand 46 that includes a handle portion that is operated by the user which hangs in a generally vertical position. The tilt wand 46 is connected through a universal joint 48 to a tilter stem 50 which rotates the tilt rod 40 by means of a worm gear 52 being engaged with a pinion gear 54. When the tilt wand 46 is rotated, the pinion gear rotates so as to actuate movement of the slats 32 (not shown) from an open position to a closed position. For reasons explained below, in the presently described embodiment, all portions of the tilt wand mechanism are hollow.

Referring back to FIG. 3, there is a second shaft assembly 42 that is mounted generally parallel to the tilt rod 40 and includes a tube 56 mounted on a drive shaft 58. Both are coupled to an output drum 70, so that rotation of the output drum 70, causes rotation of the drive shaft 58 and tube 56. The drive shaft 58 is slidably engaged with the tube 56 on one end, and the other end of the tube 56 engages a threaded rod 60, so that as the tube 56 rotates, it also translates laterally. A threaded plug 55 may be mounted on one end of the tube, and a drive plug 57 may be mounted on the other end of the tube. The lift cord 62 exits the head rail through a lift cord opening 63. One or more lift cords 62 are fixed to the tube by clips 64 or other suitable fixing devices, and as the tube 56 is rotated, the lift cords 62 are wound upward or downward, thus raising or lowering the bottom rail 56 of the blind to which the lift cords are attached. One or more end caps 66, 68 may enclose the head rail.

Figure 5:
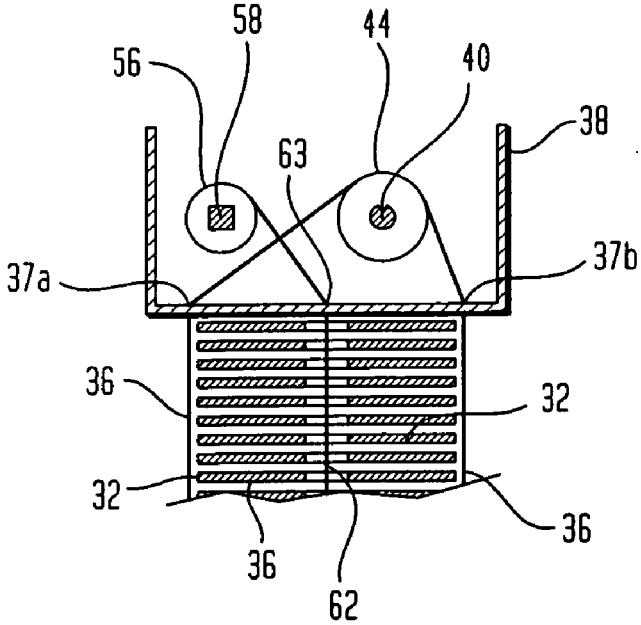
FIG. 5 is a cross-sectional view taken along line 5-5 of FIG. 3.

Referring to FIG. 5, the relative locations of the lift cord 62 and ladder cords 36 extending through their respective openings are best shown. The lift cord 62 is shown wrapped around the tube 56 and extending through the lift cord opening 63. Similarly, the ladder cords 36 are shown extending around the ladder drum 44, as well as through the ladder cord openings 37*a*, 37*b* which support the slats 32.

Figure 6:
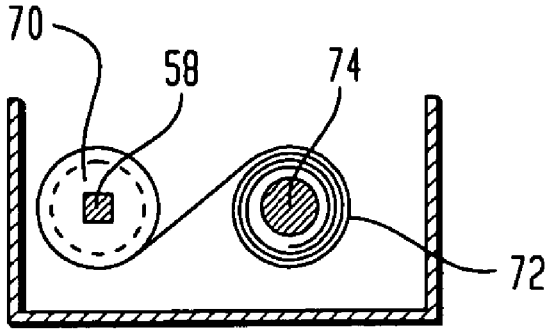
FIG. 6 is a cross-sectional view taken along line 6-6 of FIG. 3.
Figure 7:
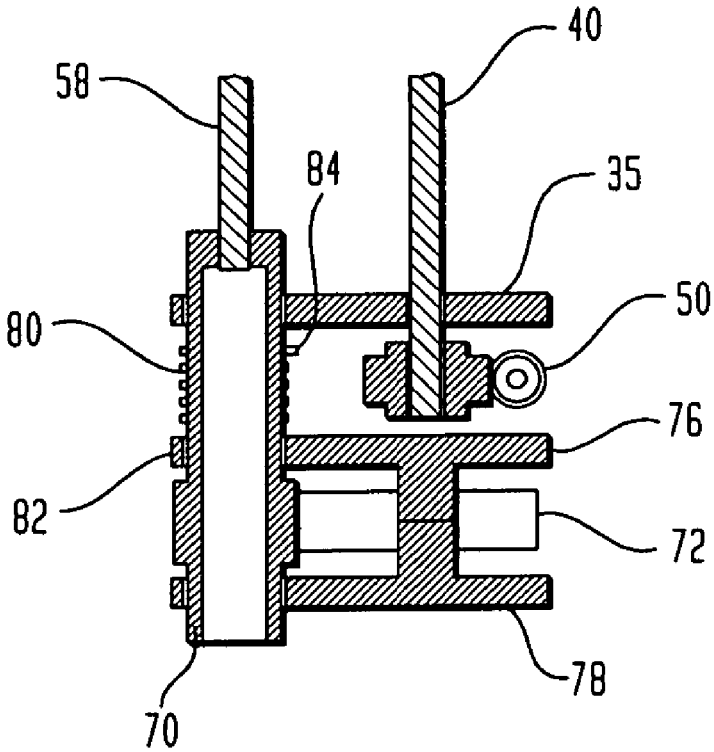
FIG. 7 is a cross-sectional view taken along line 7-7 of FIG. 4.

As shown in FIGS. 3, 6, and 7, associated with the drive shaft 58 to which the tube is connected is a spring motor which includes an output drum 70, a coil spring 72 which rests around a post 74, and a pair of walls including a center support wall 76 and a spring support wall 78 which hold the coil spring 72 in place. Referring to FIGS. 3 and 7, the output drum 70 is directly connected to the drive shaft 58. The coil spring 72 is preferably pre-stressed to have a natural or relaxed state in which the coil spring 72 forms a tightly wound coil disposed around the post 74. The free end of the coil spring is attached to output drum 70 onto which the spring is backwound by rotating the output drum 70 in a direction to backwind the spring thereon. When the holding force or load by which the spring is backwound on the output drum 70 is released, the curling property of the coil spring 72 rewinds the latter onto the post 74 toward its natural or relaxed state. It should be appreciated that the coil spring 72 may also be rewound into the post 74. Rotation of the spring motor output drum 70 moves the drive shaft, which, as will be describe in more detail below, biases the bottom rail 39 to move in an upward direction.

It will be appreciated that spring motors are known in the art of window assemblies, such as the spring motor disclosed in U.S. Pat. No. 6,318,661, the entire content of which is incorporated herein by reference. Another example of an alternate spring motor configuration concerns a drive shaft that is not directly connected to the output drum. A first gear coaxially mounted with the output drum may engage a second gear coaxially mounted with the drive shaft to cause movement of the drive shaft. This and other alternative embodiments will be described in greater detail herein.

Referring to FIGS. 3, 4 and 7, a wrap spring 80 is mounted on the output drum 70, to which drive shaft 58 to which the output drum 70 of the spring motor are coupled. One end 82 of the wrap spring 80 is fixed to a stationary wall, for example the center support wall 76. As used herein, the term wrap spring means a coiled element that is adapted to be wrapped around an element and prevent rotation of the element when the wrap spring is compressed around the element.

The wrap spring 80 is wrapped in a direction such that if the output drum 70 and drive shaft 58 are rotated in a direction that would lower the bottom rail 39, the wrap spring 80 tightens itself around the output drum 70 and provides locking force to prevent downward movement of the bottom rail 39. However, rotation of the tube 56 in the opposite direction, corresponding to raising the bottom rail 39, loosens the wrap spring 80 such that the outer drum 70, drive shaft 58 and the tube 56 attached to the drive shaft 58 can be rotated freely. It should be appreciated that in alternate embodiments, the wrap spring may be wrapped around the drive shaft 58 or tube 56.

Figure 8:
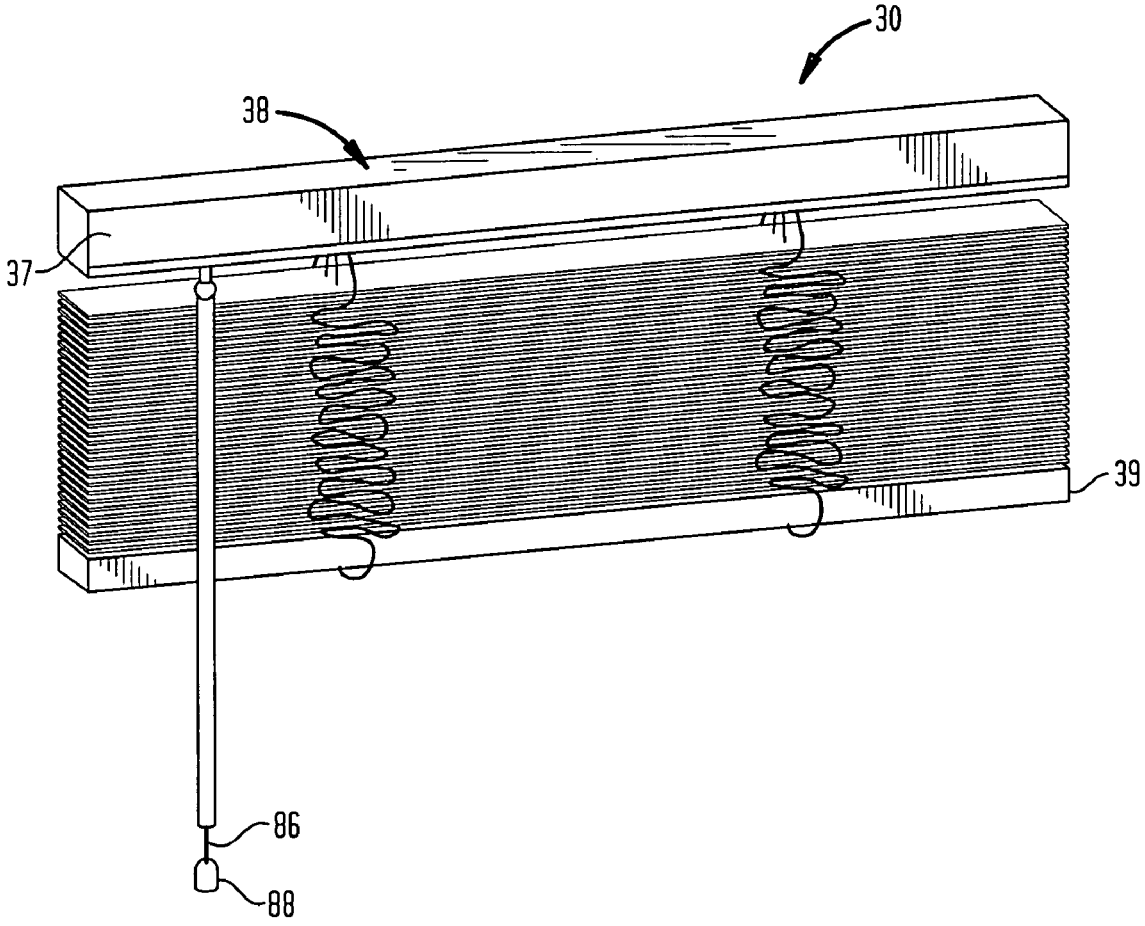
FIG. 8 is a perspective view of a Venetian blind assembly in a raised position according to one embodiment.
Figure 9:
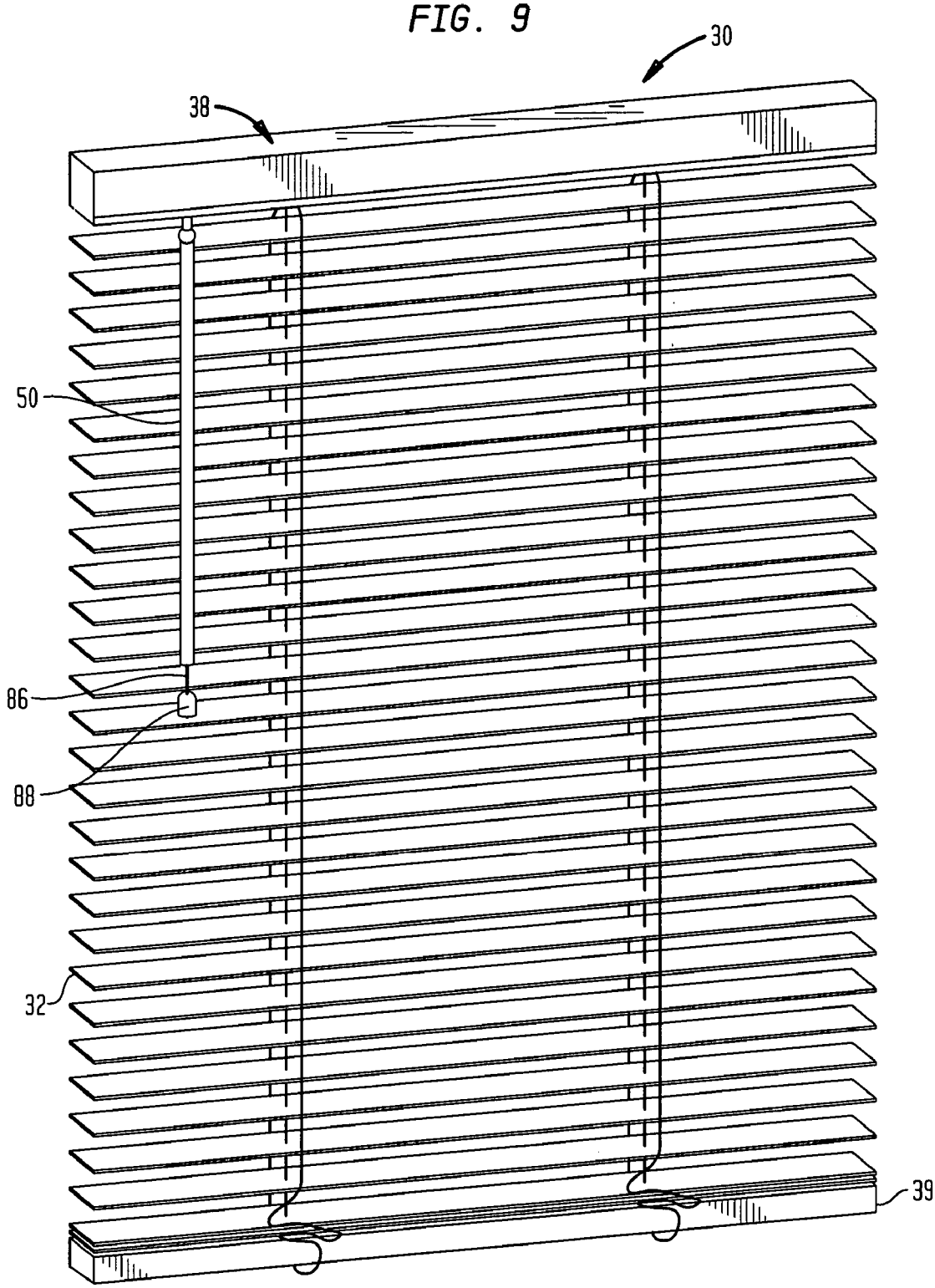
FIG. 9 is a perspective view of a Venetian blind assembly in a lowered position after the release mechanism has been activated according to one embodiment.

When the blind is in the fully raised position as shown in FIG. 8, the wrap spring 80 prevents the drive shaft 58 and tube 56 from rotating, in turn preventing the bottom rail 39 from descending. When the tassel 88 is pulled, this applies tension to the trigger cord 86, which thus loosens the wrap spring 80 from around the drive shaft 58 and allows the lift cords 62 to unwind from the tube 56 and thus permits the bottom rail 39 to descend. The blind assembly is shown in a fully lowered position in FIG. 9. As the bottom rail 39 descends, the coil spring 72 in the spring motor is extended and thus exerts an upward force. The weight of the bottom rail 39, however, is sufficient to overcome the upward force provided by the spring motor. Accordingly, when the tassel 88 is pulled, the bottom rail 39 can descend freely, although its movement is decelerated by the force of the spring motor.

When the user wishes to lift the bottom rail upward, this is done by hand. The user simply applies an upward or lifting force to the bottom of the bottom rail. When moving the bottom rail in the upward direction, the wrap spring 80 expands outward allowing the output drum 70 and drive shaft 70 to rotate, thus permitting upward movement of the bottom rail 39. However, once upward movement is completed, the weight of the bottom rail 39 tends to cause rotation of the tube 56 and output drum 70, which, in turn, causes the wrap spring 80 to wrap tightly around the output drum 70 and locks the wrap spring once again and prevents downward movement of the bottom rail 39.

Figure 10:
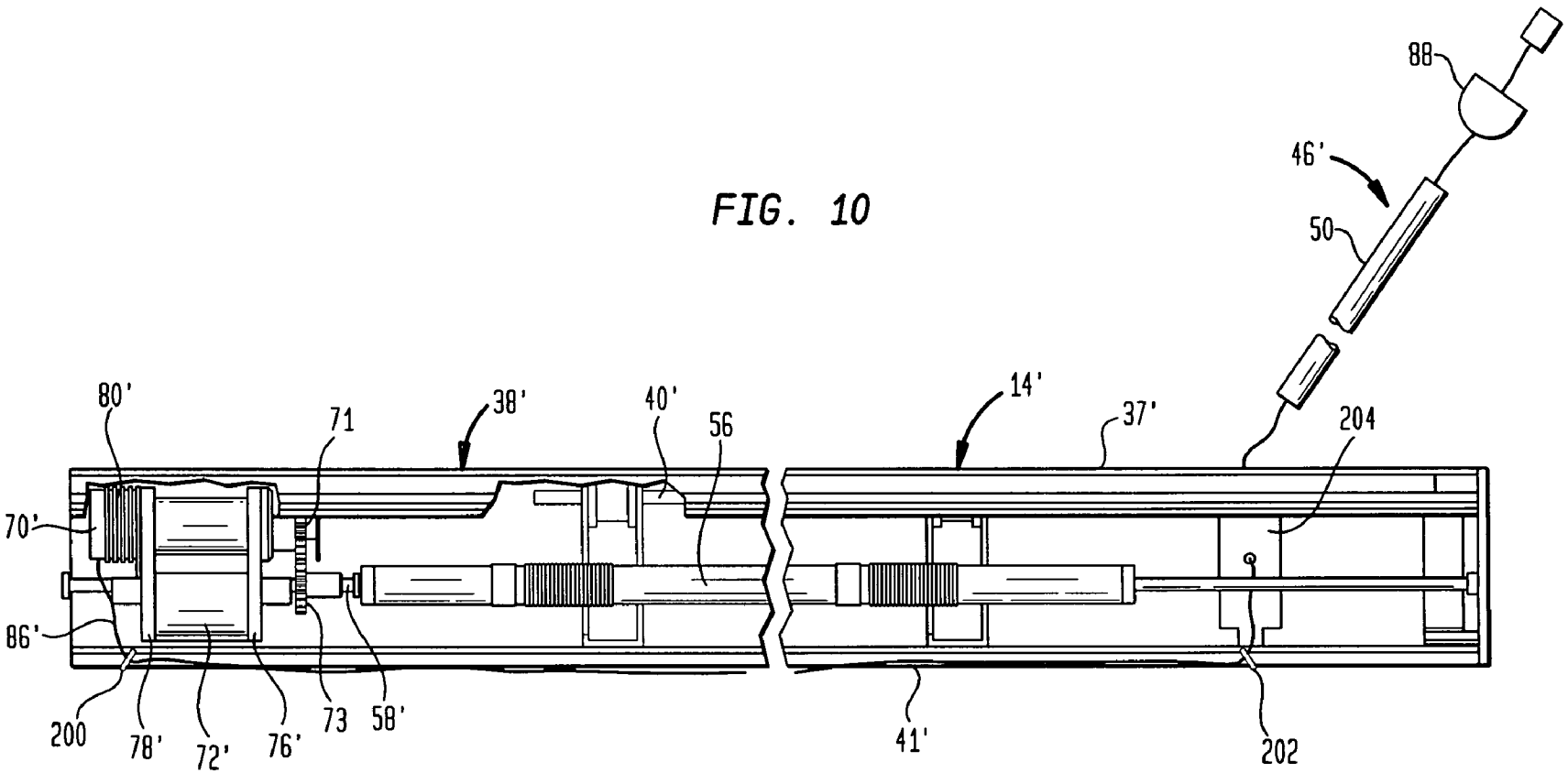
FIG. 10 is a top plan view of a headrail including a lifting system in accordance with another embodiment of the present invention.

FIGS. 10-12B show an alternative embodiment of a window covering including a lift system. The alternative window covering assembly is similar to the embodiment shown in FIGS. 3-9, except for the configuration of the spring motor system which causes the lifting and lowering of the slats 32. As shown in FIG. 10, the head rail 14' also includes two horizontally extending and generally parallel shaft assemblies mounted therein for rotation. The first shaft is a drive shaft 58' (coupled to the output tube 70' and tube 56') and the second shaft is the tilt rod 40'.

Figure 11:
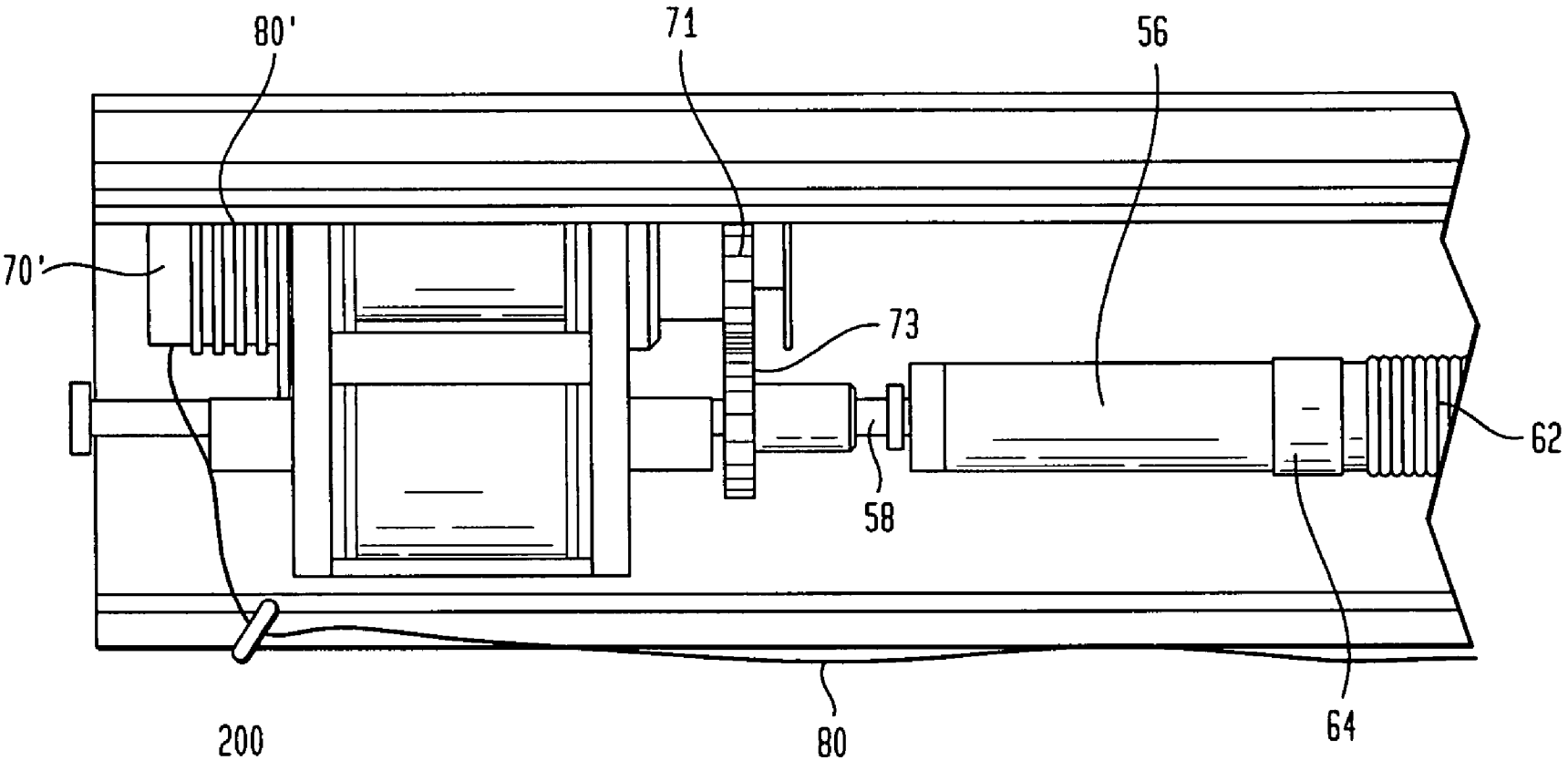
FIG. 11 is a partial top plan view of the lifting system shown in FIG. 10.
Figure 12A:
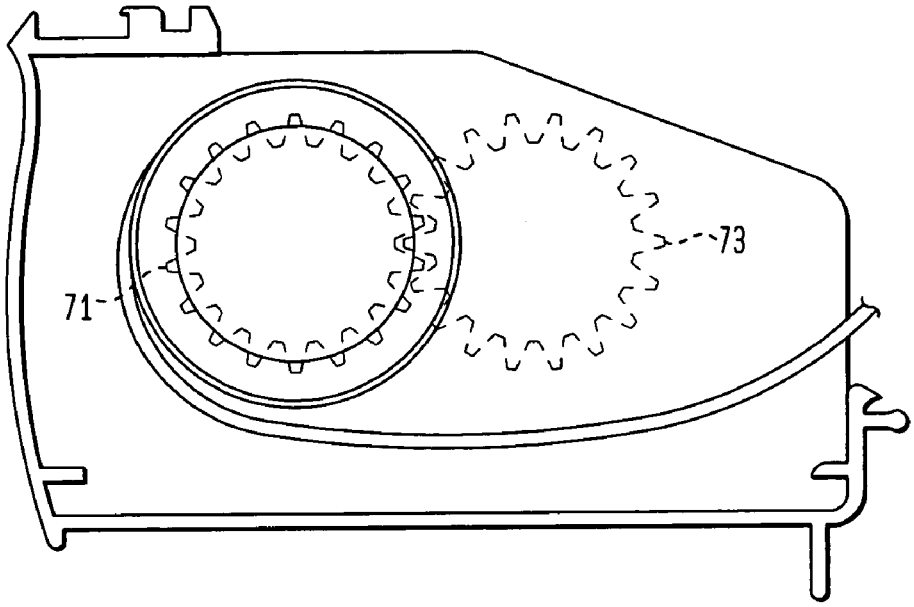
FIG. 12A is an end view showing the gears located in the head rail shown in FIG. 10.

In this alternative embodiment, the spring motor also comprises an output drum 70', a coil spring resting around a post 74', and a center support wall 76' and spring support wall 78'. As shown in FIGS. 10-12, the output drum 70' is not coaxially located with the drive shaft 58'. Instead, first and second gears 71,73 are used to transfer movement of the output drum 70' to the drive shaft 58'. A first gear 71 may be coaxially mounted to the output drum 70', which is in driving engagement with a second gear 73 coaxially mounted to the drive shaft 58'. Rotation of the output drum 70' is therefore able to cause rotation of the first gear 71, which in turn causes movement of the second gear 73 and the drive shaft 58'.

The wrap spring 80' is located to the left side of the output drum 70', and controls rotation of the coil spring 72' and the output drum 70'. When the wrap spring 80' tightens around the output drum 70', it prevents rotation of the drive shaft 58'. When the wrap spring 80' loosens around the output drum 70', rotation of the drive shaft 58' is permissible. In its locked or stationary state, the wrap spring 80' is in a tightened position around the output drum 70'.

Figure 12B:
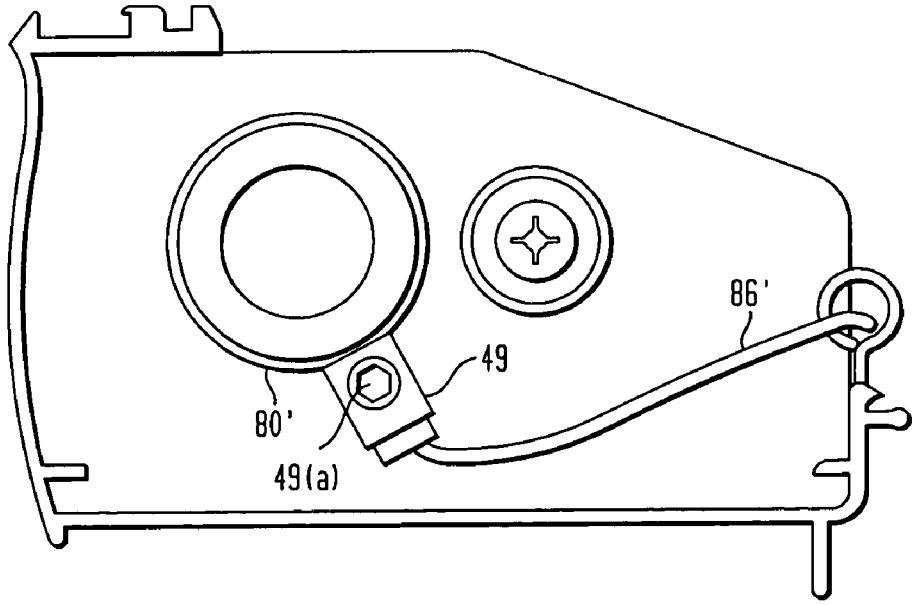
FIG. 12B is an end view illustrating the wrap spring located in the head rail shown in FIG. 10.

A trigger cord 86' attached to the wrap spring 80' at one end and application of tension to the trigger cord 86' loosens the wrap spring 80'. As shown in FIG. 12B, the trigger cord 86' can be affixed to the wrap spring 80' by a sleeve 49 and set screw 49*a* or other suitable fixation element. The trigger cord 86' preferably passes through a first eyelet 200 located on the front end of the head rail, as well as through a second eyelet 202 located a short distance away from the first eyelet 200, although any type of mechanism may be used to guide the trigger cord 86'. The trigger cord 86' then passes through the pinion gear housing 204 and extends through the wand 46'. When a pulling force is applied to the trigger cord 86', it expands and releases the wrap spring 80' from its tightened state, thereby allowing the coil spring 72' to expand and move to a released state, so as to permit rotation of the output drum 70'.

In order to tilt the slats, the tilt wand 46' is rotated and gears (not shown) in the pinion gear housing operate to allow rotation of the tilt rod 40'. Rotation of the slats is similar in operation to those known in the art such as described in the embodiments in FIGS. 3-9.

FIGS. 13-24 show yet another alternative embodiment of a window covering assembly including a lift system. A cellular shade assembly 100 is shown including a head rail 102, a bottom rail 104, and window covering material 106 extending between the head rail 102 and the bottom rail 104. Because the window covering comprises a continuous sheet of material 106 extending between the head rail 102 and the bottom rail 104, and not a plurality of slats, a tilting mechanism, tilt drum, tilt rod and other associated components for tilting slats of the window covering are not necessary.

Figure 13:
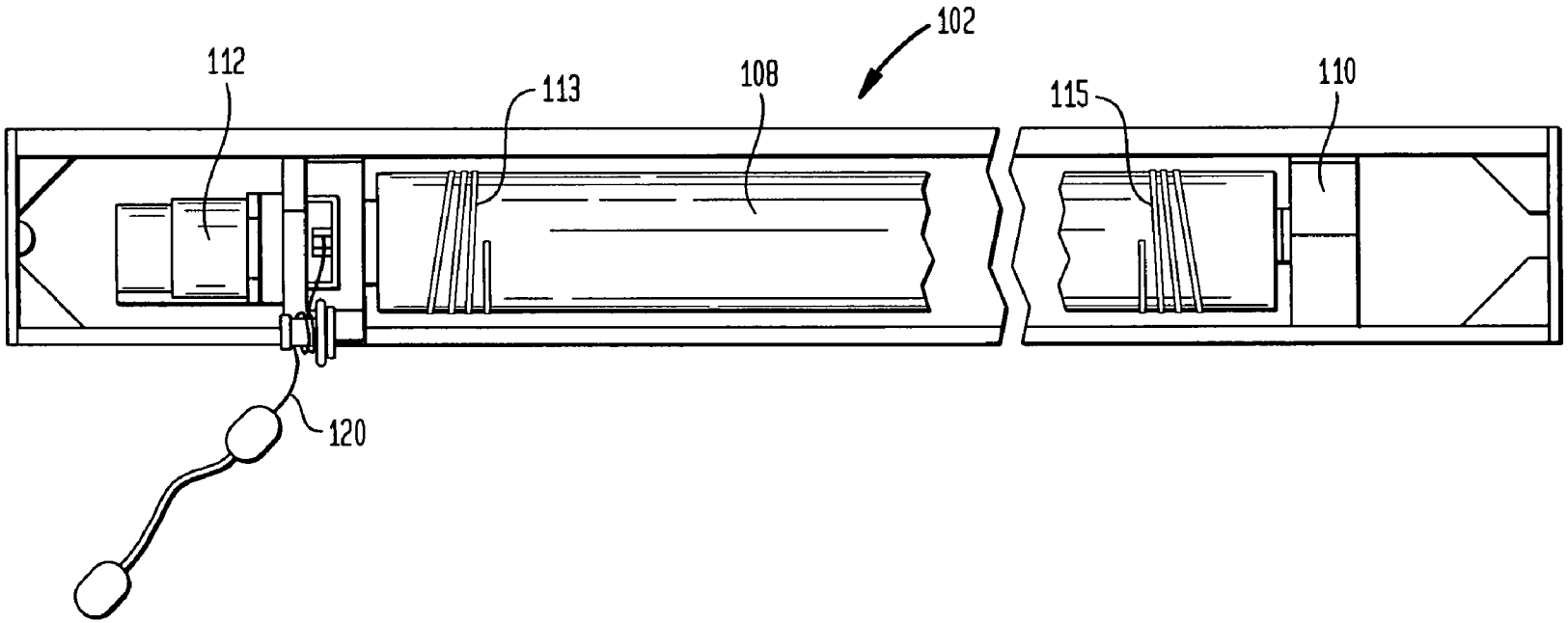
FIG. 13 is a top plan view of a portion of a lifting system and release mechanism according to yet another embodiment in accordance with the present invention.

As shown in FIG. 13, the head rail 102 includes a horizontally extending drive shaft (which may be in the shape of a tube) (not shown) extending between supports 110, 112. A tube 108 is mounted coaxially with the drive shaft and surrounds the drive shaft, and at least one, and preferably a pair of lift cords 113, 115 are affixed to the tube 108 and connected to the bottom rail 104.

Figure 14:
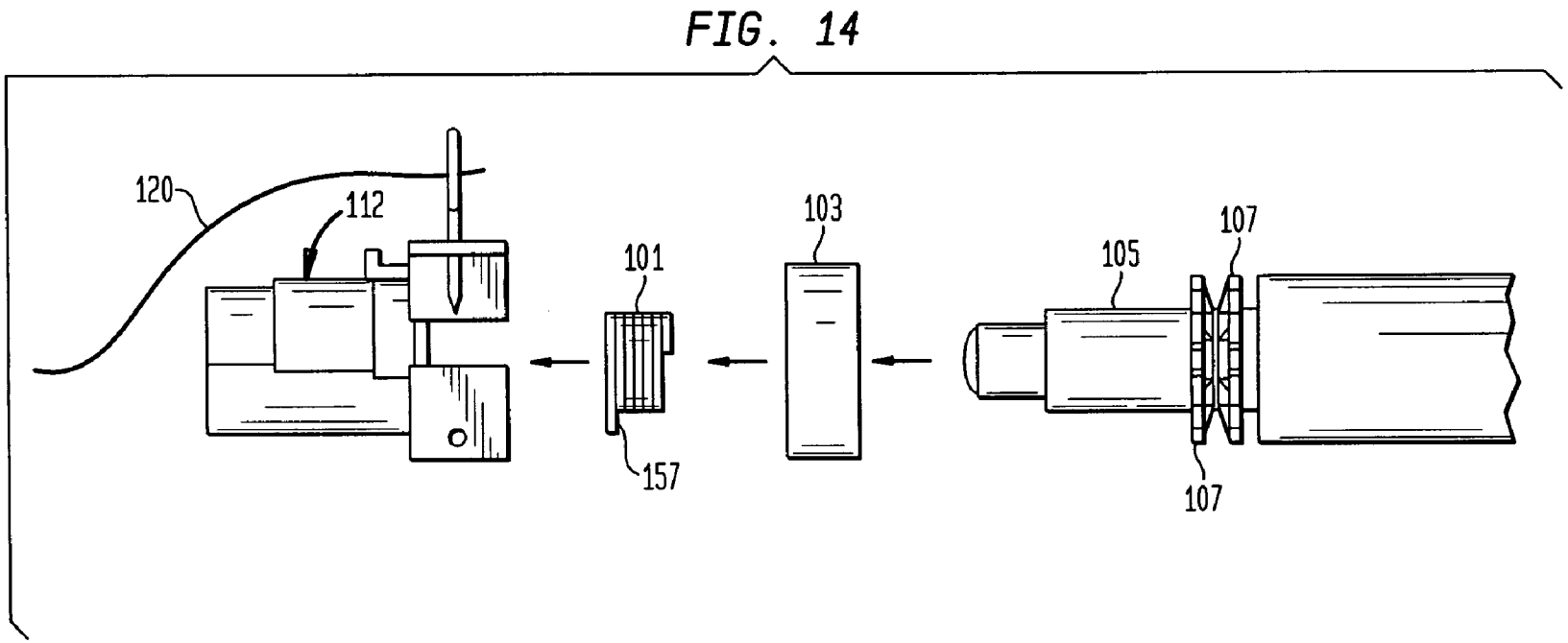
FIG. 14 is an exploded perspective view of the unassembled components of a portion of the window blind assembly shown in FIG. 13.
Figure 15:
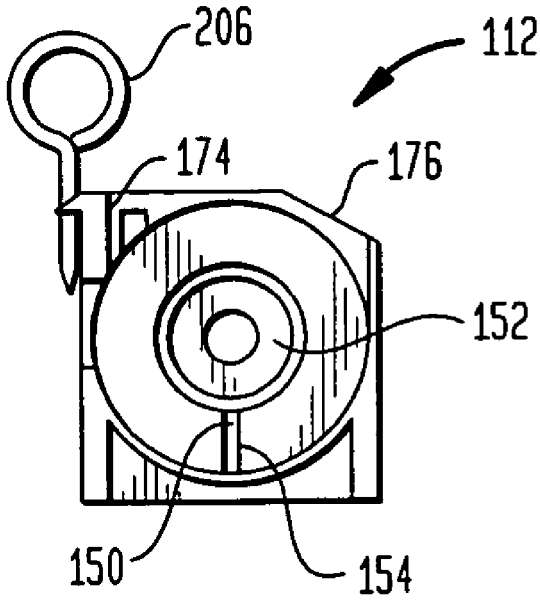
FIG. 15 is a front elevational view of the support shown in FIG. 14.
Figure 16:
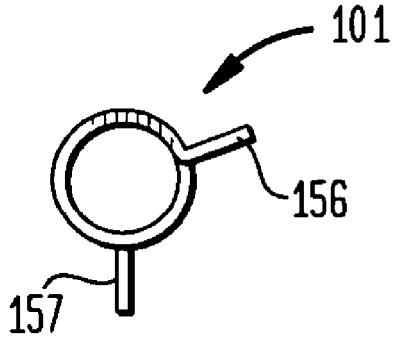
FIG. 16 is a front elevational view of a wrap spring shown in FIG. 14.

Referring to FIG. 14, shown are the support 112, a wrap spring 101, a wrap spring control or release 103, and a drive shaft 105 having drive shaft spokes 107. As best shown in FIG. 15, the support 112 has a hollow circular interior that is constructed and designed to receive the wrap spring 101, wrap spring release 103, and drive shaft 105. The circular interior of the support 112 has various radii so as to create edges 150, 152, which will limit movement of these components.

Figure 17:
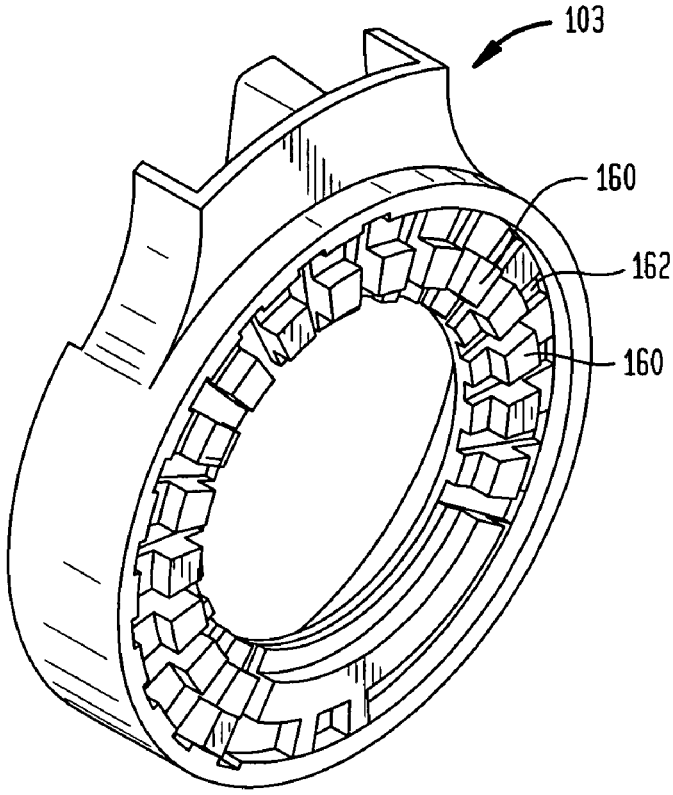
FIG. 17 is a perspective view of a first side of a wrap spring release shown in FIG. 14.
Figure 18:
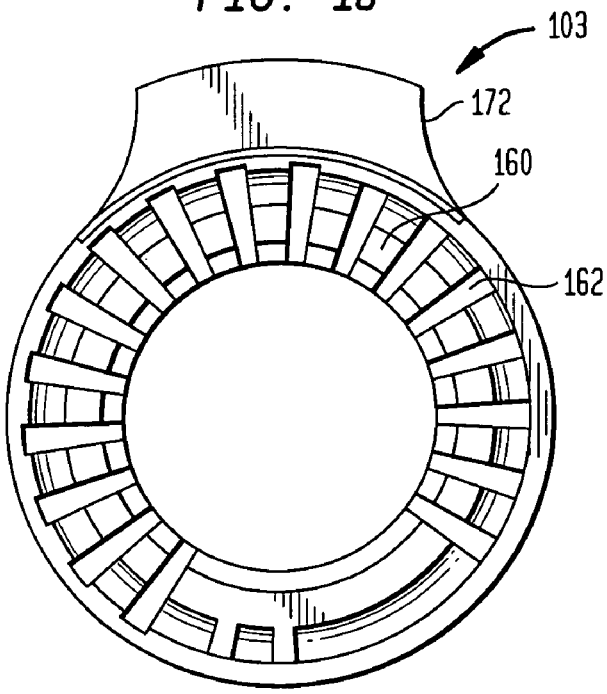
FIG. 18 is a plan view of the first side of the wrap spring release shown in FIG. 17.
Figure 19:
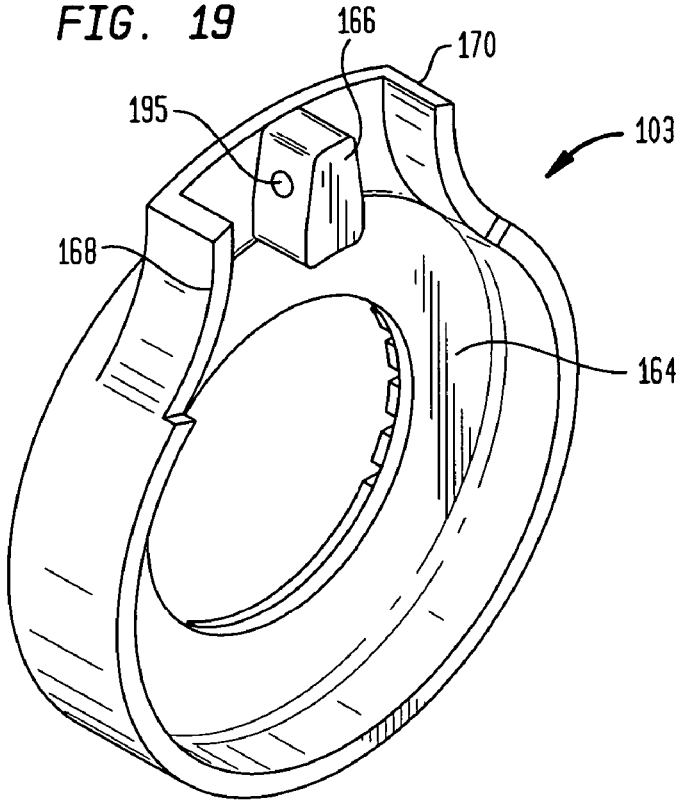
FIG. 19 is a perspective view of the second side of the wrap spring release shown in FIG. 14.
Figure 20:
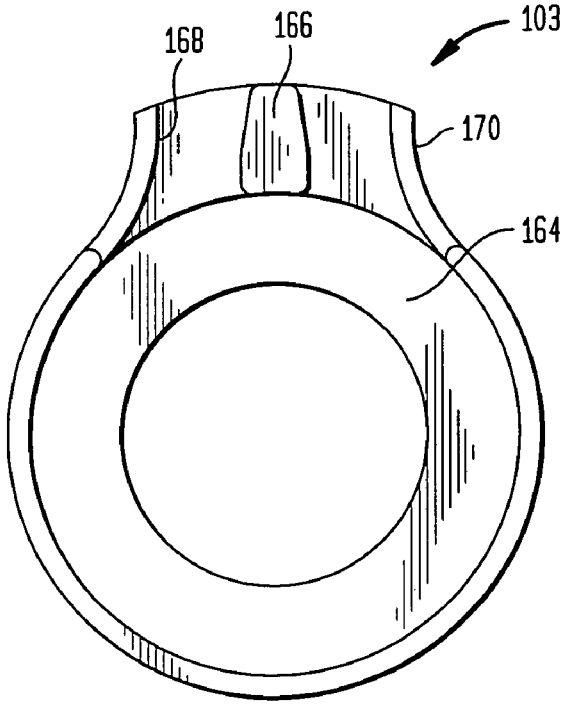
FIG. 20 is a plan view of the second side of the wrap spring release shown in FIG. 19.

As shown in FIGS. 17-20, the wrap spring release 103 has two sides. The first side shown in FIGS. 17-18 shows ridges 160 dispersed around the circumference of the wrap spring release 103. Divets 162 are located between each of the ridges 160. The second side of the wrap spring release 103, as shown in FIGS. 19-20 has a recessed wall 164 and a neck divider 166 located between the edges 168, 170 of the neck 172.

Figure 21:
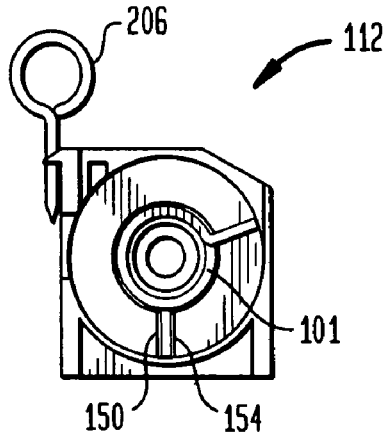
FIG. 21 is a front elevational view of the wrap spring within the support in accordance with the present invention.
Figure 22:
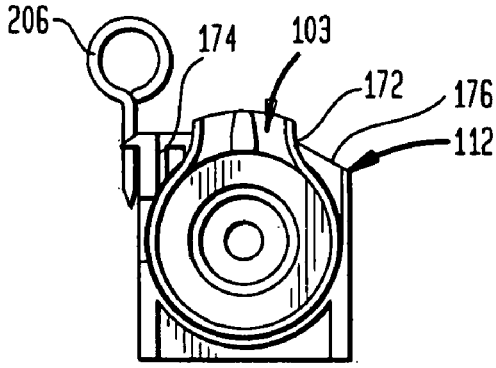
FIG. 22 is a front elevational view of the assembled support, wrap spring and wrap spring release.

In order to assemble these components together, the wrap spring 101 is placed into the support 112, as shown in FIG. 21. The stem 157 fits into the stem receiver 154 on the support 112. Edge 150 prevents the wrap spring 101 from advancing further into the support 112, and keeps the wrap spring 101 in a stationary position. As shown in FIG. 22, the wrap spring release 103 is then placed into the support 112, with the first side facing the wrap spring 101 so that the stem 157 of the wrap spring 101 engages a divet 162 on the first side of the wrap spring release 103. Once the wrap spring release 103 is placed into the support 112, the position of the neck 172 will depend on the position of the stem 156 in the divet 162. In a preferred embodiment, the wrap spring stem 156 is predesigned to align with a divet 162 on the wrap spring release 103 in order to allow the neck 172 to have a full range of motion between the edges 174 and 176 of the support 112. Once the wrap spring release 103 and wrap spring 101 are positioned within the support, the drive shaft 105 can be inserted into the support 112.

Figure 23:
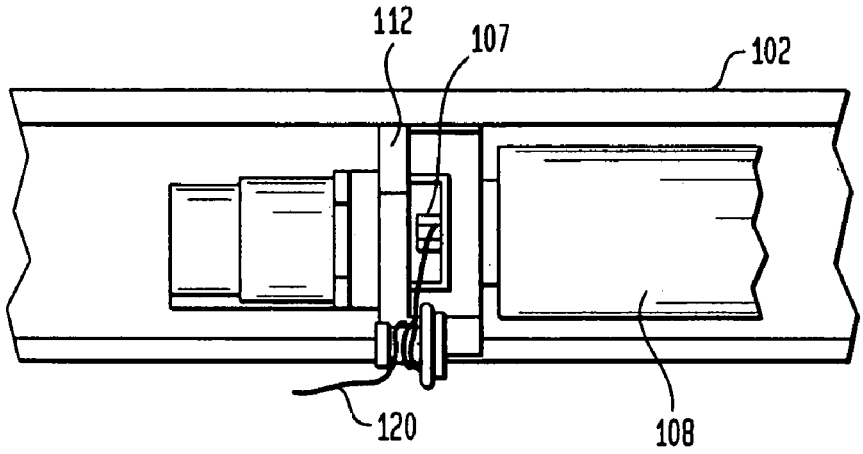
FIG. 23 is a top view of a portion of the lift system shown in FIG. 13.

As shown in FIG. 23, once the drive shaft 105 is assembled into the support 112, a trigger cord 120 can than be placed through an eye hook 206 (see FIG. 15) and attached to the neck divider 166 found on the neck 172 of the wrap spring release 103, using known methods of attachment such as a clip or an adhesive. For example, the trigger cord 120 may be tied through the hole 195 (see FIG. 19) on the neck divider 166. Alternatively, wrap spring release 103 can be designed so that the neck divider 166 is removed, thereby allowing the trigger cord 120 to be directly attached to the neck 172.

It is to be understood that prior to securing the drive shaft in the support 112, a torsion spring (not shown) can be wrapped around the drive shaft and enclosed by the tube 108. The torsion spring is wrapped and placed under tension so that the bottom rail 104 is biased to move upward. The torsion spring used in this embodiment is similar to the type of torsion springs used in standard roll-up window shades. Various brake means may be used to limit rotation of the drive shaft 105. In a preferred embodiment, the wrap spring 101 is used to control movement of the drive shaft. This configuration of the wrap spring is similar to the previously described embodiment shown in FIGS. 1-12B. However, according to other embodiments, the lift system according to one or more embodiments can include the same components (i.e., the spring motor, output drum, coil spring, post, gears, etc.) associated with the drive shaft in the previously described embodiment.

It is to be further understood that the wrap spring 101 is wrapped in a direction such that if the drive shaft is rotated in a direction that would raise the bottom rail, the wrap spring tightens itself around the drive shaft and prevents upward movement of the bottom rail. However, rotation of the tube 108 in the opposite direction, corresponding to lowering the bottom rail 104, tightens the wrap spring around the drive shaft.

When the blind is in the fully raised position, the wrap spring 101 allows the drive shaft and tube 108 to rotate, in turn allowing the bottom rail 104 to descend when an operator pulls down on the bottom rail. When the tassel 122 on the trigger cord 120 is pulled, the trigger cord 120 causes movement of the wrap spring release 103, which in turn loosens the wrap spring 101 from around the drive shaft 105. This allows the lift cords 113, 115 to wind onto the tube 108 and thus permits raising the bottom rail 104.

Figure 24:
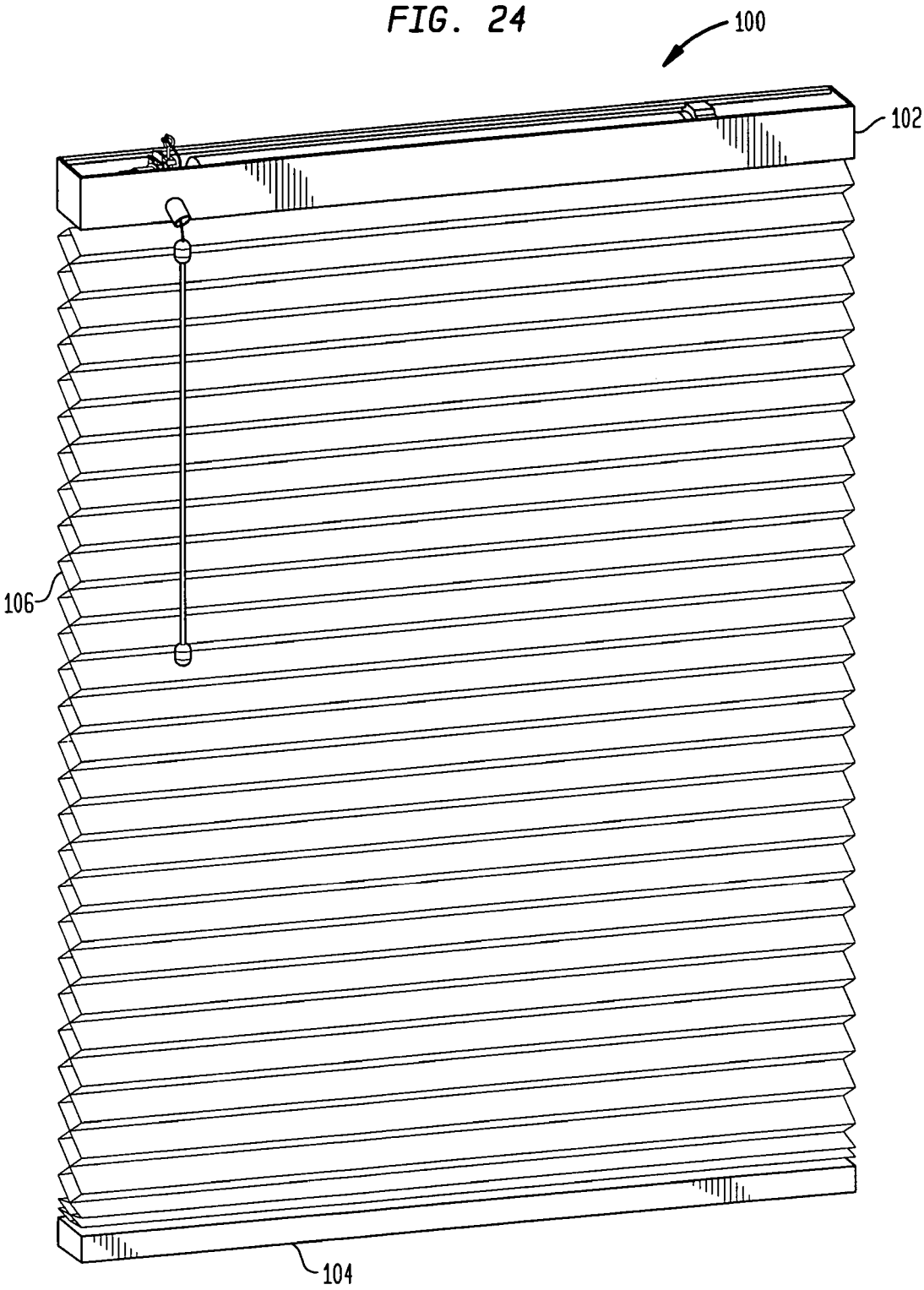
FIG. 24 is a front view of a cellular shade in a lowered position of the window covering assembly shown in FIG. 13.

The blind assembly is shown in a lowered position in FIG. 24. As the bottom rail 104 descends, the coil spring in the spring motor (or the torsion spring in the tube) is extended and thus exerts an upward force. The weight of the bottom rail 104 and the weight of the window covering, however, is not sufficient to overcome the upward force provided by the spring motor. The wrap spring prevents the bottom rail from moving upward. When the tassel 122 is pulled, the bottom rail 104 can move up freely.

When the user wishes to lower the bottom rail 104, this is done manually by hand. The user may exert a downward force on the bottom rail. When moving in that downward direction, the wrap spring expands outward allowing the drive shaft to rotate, thus permitting downward movement of the bottom rail 104. However, once downward movement is completed, the force of the spring motor tends to cause rotation of the tube 108 and drive shaft, which in turn causes the wrap spring to wrap tightly around the drive shaft and locks the wrap spring once again and prevents upward movement of the bottom rail 104.

Although the invention herein has been described with reference to particular embodiments, it is to be understood that these embodiments are merely illustrative of the principles and applications of the present invention. For example, although the various embodiments show a pair of cords, more cords could be used in the fabrication wider window covering assemblies. It is therefore to be understood that numerous modifications may be made to the illustrative embodiments and that other arrangements may be devised without departing from the spirit and scope of the present invention as defined by the appended claims as well as configurations and sub-configurations of features set forth therein.

The invention claimed is:

1. A window covering assembly comprising:

a head rail, said head rail having a first end and a second end;

a bottom rail;

at least one lift cord running through the head rail and the bottom rail;

a window covering extending between the head rail and the bottom rail, said window covering operatively connected to the lift cord, and said window covering having a length extending between at least a portion of said first end and said second end;

a lift system for raising and lowering said window covering, including an element that biases the bottom rail to move in an upward direction;

a rotatable drive shaft operable to raise or lower the window covering upon rotation, said rotatable drive shaft extending a distance between said first end and said second that is at least as long as said length of said window covering; and a wrap spring operatively engaged with the lift system, the wrap spring configured to selectively prevent or permit raising and lowering of said window covering.

2. The window covering of claim 1, wherein said lift system further includes a spring motor coupled to the drive shaft in a manner to rotate the drive shaft, wherein said wrap spring is coupled to the drive shaft and has a locked state for preventing rotation of said drive shaft and an unlocked state for allowing rotation of said drive shaft.

3. The window covering of claim 2, wherein said drive shaft rotates in a first direction when said wrap spring is in said unlocked state.

4. The window covering of claim 2, wherein said drive shaft is prevented from rotating in a first direction when said wrap spring is in said locked state.

5. The window covering of claim 1, wherein said drive shaft rotates in a first direction to raise said window covering.

6. The window covering of claim 1, wherein said drive shaft rotates in a first direction to lower said window covering.

7. The window covering of claim 1 wherein said wrap spring is coaxially aligned with the drive shaft.

8. A window covering assembly comprising:

a head rail;

a bottom rail;

a window covering extending between the head rail and the bottom rail;

at least one lift cord extending between the head rail and the bottom rail;

a lift system associated with the head rail, said lift system including:

a rotatable drive shaft mounted in the head rail, a post mounted in the head rail, a spring motor coupled to the drive shaft and the post in a manner to rotate the drive shaft, and a wrap spring associated with the drive shaft, said wrap spring having a tightened configuration for preventing rotation of said drive shaft, and a loosened configuration for allowing rotation of said drive shaft.

9. The window covering of claim 8, wherein said wrap spring is wrapped in a direction to prevent the lowering of said window covering.

10. The window covering of claim 8, wherein said drive shaft rotates in a first direction when said wrap spring is in said loosened configuration.

11. The window covering of claim 8, wherein said drive shaft is prevented from rotating in a first direction when said wrap spring is in said tightened configuration.

12. The window covering of claim 8, wherein said drive shaft rotates in a first direction to raise said window covering.

13. The window covering of claim 8, wherein said drive shaft rotates in a first direction to lower said window covering.

14. The window covering of claim 8 wherein said wrap spring is coaxially aligned with the drive shaft.

15. The window covering of claim 8, further comprising a trigger cord and a hollow tilt wand extending through the head rail, and wherein said trigger cord is threaded through said tilt wand.

16. The window covering assembly of claim 8, wherein said window covering includes a Venetian blind.

17. A window covering assembly comprising:

a head rail;

a bottom rail;

a window covering extending between the head rail and the bottom rail;

at least one lift cord extending between the head rail and the bottom rail;

at least one pair of ladder cords for supporting a plurality of slats;

a lift system associated with the head rail, said lift system including:

a rotatable shaft assembly and a drive shaft mounted in the head rail, a tube surrounding a portion of the drive shaft, wherein one end of the tube is slidably engaged with the drive shaft, and the other end of the tube is engaged with a threaded rod to allow lateral translation of the tube as the tube rotates, a post mounted in the head rail, a spring motor coupled to the drive shaft and the post in a manner to rotate the drive shaft, and a wrap spring associated with the drive shaft, the wrap spring being wrapped in a manner to prevent rotation of the drive shaft and tube in a pre-determined direction.

18. The window covering assembly of claim 17, wherein said spring motor includes an output drum and a coil spring.

19. A window covering comprising:

a head rail;

a bottom rail;

a window covering extending between head rail and bottom rail;

a lift cord attached to the bottom rail;

a take up member located in the head rail for taking up said lift cord when the window covering is raised; and a lifting mechanism further including a shaft associated with a head rail, a spool mounted to said shaft, a spring motor operatively coupled to the spool for rotating said spool, and a release mechanism for selectively allowing and preventing rotation of the drive shaft, said release mechanism including a wrap spring to prevent rotation of the tube in a direction that will lower the window covering, and a trigger coupled to the wrap spring for releasing the wrap spring to allow the spool to rotate and lower the blind.

20. A method for the assembling a window covering assembly comprising:

providing the components of a window treatment, the window treatment including a head rail, a bottom rail, a window covering disposed between said head rail and bottom rail, a drive shaft, and a spring motor;

providing sufficient weight in said bottom rail so that said base rail provides a greater downward force than the upward force provided by said spring motor;

coupling a wrap spring to said drive shaft to prevent rotation of said drive shaft in a downward direction; and attaching a trigger cord to said wrap spring so as to allow rotation of said shaft in a downward direction when a user pulls on said trigger cord.

21. A method of raising and lowering a window covering including a drive shaft mounted in a head rail, said head rail extending a distance at least equal to a length of said window covering, a drive shaft extending a distance at least equal to said length of said window covering, said drive shaft operably connected to the window covering comprising biasing the drive shaft to move in a predetermined direction, applying a compressive force of a wrap spring coiled around the drive shaft or a member coupled to the drive shaft to prevent rotation of the drive shaft and releasing the compressive force from the drive shaft or a member coupled to the drive shaft to permit rotation of the drive shaft and movement of the window covering.

22. A window covering assembly comprising:

a head rail;

a bottom rail;

at least one lift cord running through the head rail and the bottom rail;

a window covering extending between the head rail and the bottom rail, said window covering operatively connected to the lift cord;

a lift system for raising and lowering said window covering, including means for biasing the bottom rail to move in an upward direction, the lift system including a rotatable drive shaft operable to raise or lower said window covering upon rotation; and means for providing locking force to prevent the bottom rail from moving in an predetermined direction, said means for biasing and said means for providing locking force being coaxially aligned on the rotatable drive shaft.

23. A window covering assembly comprising:

a head rail;

a bottom rail;

a window covering extending between the head rail and the bottom rail;

at least one lift cord extending between the head rail and the bottom rail;

a lift system associated with the head rail, said lift system including:

a rotatable drive shaft mounted in the head rail, a spring motor coupled to the drive shaft, a wrap spring associated with the drive shaft, said wrap spring having a tightened configuration for preventing rotation of said drive shaft, and a loosened configuration for allowing rotation of said drive shaft, and a trigger cord attached to said wrap spring to selectively engage said wrap spring between the tightened and loosened configurations when tension is applied and released to the trigger cord.

24. A window covering assembly comprising:

a head rail;

a bottom rail;

a window covering extending between the head rail and the bottom rail;

at least one lift cord extending between the head rail and the bottom rail;

at least one pair of ladder cords for supporting a plurality of slats; and a lift system associated with the head rail, said lift system including:

a rotatable shaft assembly and a drive shaft mounted in the head rail, a tube surrounding a portion of the drive shaft, wherein one end of the tube is slidably engaged with the drive shaft, and the other end of the tube is engaged with a threaded rod to allow lateral translation of the tube as the tube rotates, a spring motor associated with the drive shaft, a wrap spring associated with the drive shaft, the wrap spring being wrapped in a manner to prevent rotation of the drive shaft and tube in a pre-determined direction, and a trigger cord attached to a first end of said wrap spring, wherein tension applied to the trigger cord causes said wrap spring to be loosened to allow rotation of the drive shaft and tube in a pre-determined direction when said trigger cord is engaged.

25. The window covering assembly of claim 1, wherein said lift system further includes a post and a spring motor, said spring motor coupled to said rotatable drive shaft and said post in a manner to rotate said drive shaft.

26. The window covering assembly of claim 1, wherein said at least one lift cord is disposed on said rotatable drive shaft so that said lift cord is coaxially aligned with said wrap spring.

* * * * *

UNITED STATES PATENT AND TRADEMARK OFFICE

CERTIFICATE OF CORRECTION

PATENT NO. : 7,287,570 B2
APPLICATION NO. : 10/951216
DATED : October 30, 2007
INVENTOR(S) : Toralf H. Strand It is certified that error appears in the above-identified patent and that said Letters Patent is hereby corrected as shown below:

Column 3, line 45 “take up” should read --take-up--.
Column 5, line 52 “relates” should read --relate--.
Column 5, line 62 “show” should read --shows--.
Column 6, line 16 after “herein” insert --,--.
Column 6, line 27 “an” should read --a--.
Column 7, line 27 “describe” should read --described--.
Column 7, line 41 “are” should read --is--.
Column 9, line 38 after “19-20” insert --,--.
Column 10, line 37 after “raising” insert --of--.
Column 10, line 42 “is” should read --are--.
Column 11, line 22 after “second” insert --end--.
Column 12, line 52 after “between” insert --the--.
Column 12, line 53 before “bottom” insert --the--.
Column 12, line 55 “take up” should read --take-up--.
Column 13, line 1 after “assembling” insert --of--.
Column 13, line 43 “an” should read --a--.

Signed and Sealed this

Twenty-fifth Day of November, 2008

JON W. DUDAS
*Director of the United States Patent and Trademark Office*